United States Patent [19]

Egnaczak

[11] 3,968,271

[45] July 6, 1976

[54] COATING APPARATUS AND USES THEREOF

[75] Inventor: Raymond K. Egnaczak, Williamson, N.Y.

[73] Assignee: Xerox Corporation, Stamford, Conn.

[22] Filed: Feb. 22, 1974

[21] Appl. No.: 444,942

Related U.S. Application Data

[63] Continuation of Ser. No. 209,611, Dec. 20, 1971, abandoned.

[52] U.S. Cl. ..... 427/15; 118/DIG.2; 118/410; 355/10; 427/74; 427/356; 427/358; 118/637

[51] Int. Cl.[2] ..... B05C 3/02

[58] Field of Search ..... 118/259, 410, 411, 412, 118/413, 407, 429, DIG. 23, DIG. 4, DIG. 2, 637; 117/37 LE; 355/10; 427/356, 358, 15, 74

[56] References Cited

UNITED STATES PATENTS

| | | | |
|---|---|---|---|
| 2,230,876 | 2/1941 | Wysong | 118/410 |
| 2,308,034 | 1/1943 | Van Der Hoef | 118/413 |
| 2,474,691 | 6/1949 | Roehm | 118/410 |
| 2,714,413 | 8/1955 | Hunter et al. | 154/1.6 |
| 2,761,791 | 9/1956 | Russell | 117/34 |
| 2,942,293 | 11/1960 | Wahl | 18/5 |
| 3,070,066 | 12/1962 | Faeber | 118/413 |
| 3,088,434 | 5/1963 | Sprague et al. | 118/410 |
| 3,094,914 | 6/1963 | Smith | 95/89 |
| 3,112,528 | 12/1963 | Czerkas | 118/413 |
| 3,227,136 | 1/1966 | Bartlett et al. | 118/410 |
| 3,302,610 | 2/1967 | Mahoney | 117/111 F |
| 3,348,526 | 10/1967 | Neubauer | 118/410 |
| 3,372,027 | 3/1968 | Gundlach et al. | 96/1 R |
| 3,484,279 | 12/1969 | Clark et al. | 117/111 F |
| 3,521,602 | 7/1970 | Coghill | 118/410 |
| 3,659,553 | 5/1972 | Tobias | 118/261 |
| 3,663,219 | 5/1972 | Takahashi | 96/1.4 |
| 3,690,297 | 9/1972 | Dentch et al. | 118/410 |
| 3,697,302 | 10/1972 | Ihara et al. | 117/34 |
| 3,698,355 | 10/1972 | Heijnis | 118/411 |

*Primary Examiner*—Michael R. Lusignan
*Attorney, Agent, or Firm*—James J. Ralabate; Michael H. Shanahan; Charles E. Smith

[57] ABSTRACT

A coating apparatus in which a coating material is passed from an internal reservoir through a narrow orifice to a surface to be coated. At the end of the orifice the apparatus has two surfaces which are adjacent the surface to be coated, one of which is closer to the surface to be coated and functions as a metering surface. A reservoir of coating material is built up between the other surface and the surface to be coated and coating material is metered therefrom. The apparatus is particularly suited for applying an imaging suspension to an electrode of a photoelectrophoretic imaging system.

2 Claims, 3 Drawing Figures

Fig. 2.
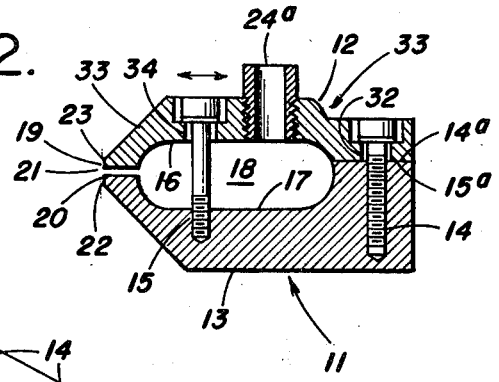
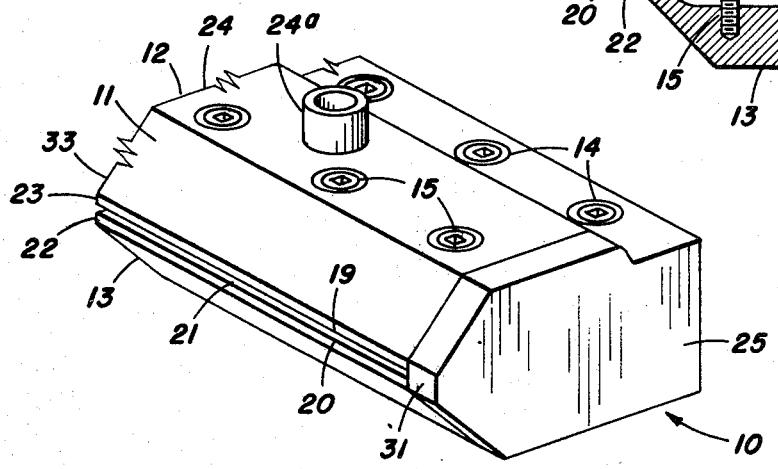
Fig. 1.
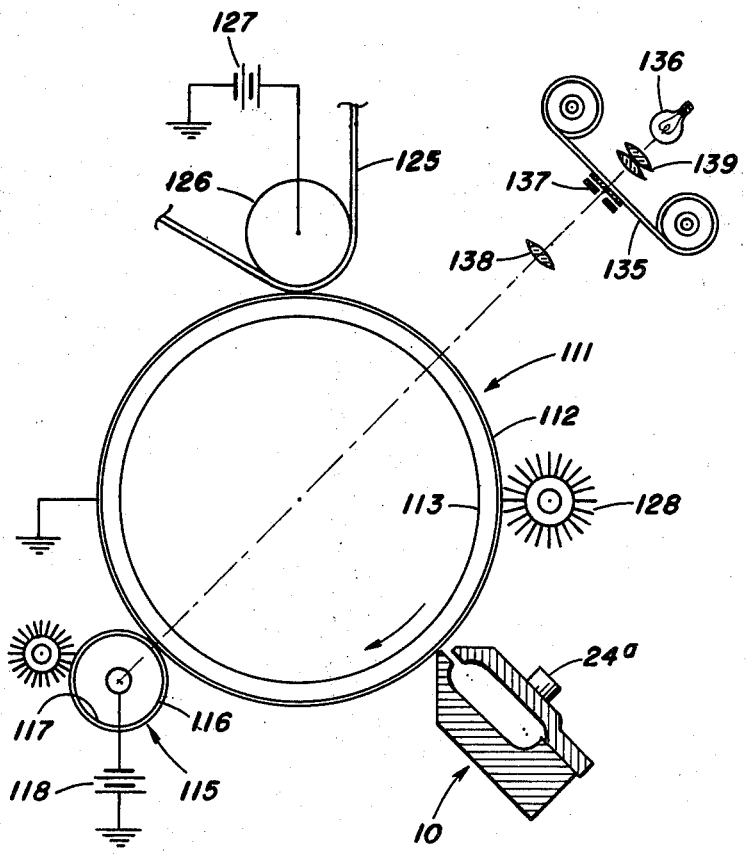
Fig. 3.

COATING APPARATUS AND USES THEREOF

CROSS-REFERENCE TO RELATED APPLICATIONS

This application is a continuation of copending application Ser. No. 209,611, filed Dec. 20, 1971 now abandoned

FIELD OF THE INVENTION

This invention relates to coating apparatus. This invention further relates to a coating apparatus for use in an imaging system, and more particularly to a coating apparatus for an electrophoretic imaging system and an improved electrophoretic imaging system including such apparatus.

BACKGROUND OF THE INVENTION

In many systems there is a need to continuously apply a uniform coating of a coating material onto a surface. An example of such a system is an electrophoretic imaging system, as described in detail in U.S. Pat. Nos. 3,384,565; 3,384,566 and 3,383,993, all granted on May 21, 1968. In such an imaging system, variously colored light absorbing particles are suspended in a non-conductive liquid carrier. The suspension is placed between electrodes, subjected to a potential difference and exposed to an image. As these steps are completed, selected particle migration takes place in image configuration, providing a visible image on one or both of the electrodes. An essential component of the suspended particles must be photosensitive and apparently undergoes a net change in charge polarity upon exposure to activating electromagnetic radiation, through interaction with one of the electrodes. In a monochromatic system, particles of a single color are used, producing a single colored image equivalent to conventional black-and-white photography. In a polychromatic system, the images are produced in natural color because mixtures of particles of two or more different colors, which are each primarily sensitive to light of a specific wavelength or narrow range of wave-lengths, are used. Particles used in this system must have both intense and pure colors and be highly photosensitive.

Ordinarily, electrophoretic imaging systems include a transparent, conductive injecting electrode upon which the dispersion of photosensitive particles in an insulating liquid is coated. The image to be reproduced is projected on the suspension on the injecting electrode. During exposure, a potential, usually of from 300 to 3,000 volts is imposed on the suspension between the injecting electrode and a relatively insulating blocking electrode. This blocking electrode, ordinarily in the form of a roller or an endless belt or web, consists of a conductive core with an insulating surface. This blocking electrode is passed across the surface of the liquid suspension during exposure. Unwanted photosensitive particles migrate to the surface of the blocking electrode, leaving an image on the injecting electrode corresponding to the original.

In the use of the above process in a continuous imaging machine, there is a need to uniformly provide the layers of the imaging suspension to one of the electrodes in order to form the best images.

SUMMARY OF THE INVENTION

An object of this invention is to provide an improved coating apparatus.

Another object of this invention is to provide a coating apparatus for uniformly coating a surface.

A further object of this invention is to provide an improved electrophoretic imaging system.

Still another object of this invention is to provide an electrophoretic imaging system in which a uniform coating of a dispersion of photosensitive particles is applied to one of the electrodes thereof.

These and other objects of the invention should be more readily apparent from reading the following detailed description thereof.

The objects of this invention are broadly accomplished, in one aspect, by providing a coating apparatus which includes a reservoir for the coating material and a passage for passing the coating material from the reservoir to the surface to be coated. The apparatus, at the end of the passage, includes two surfaces which are adapted to be placed closely adjacent to the surface to be coated, one of the two surfaces of the apparatus being positioned closer to the surface to be coated than the other, the aforesaid one surface functioning as a metering surface. A reservoir of coating material is built up between the surface to be coated and the other of the two surfaces of the apparatus, with the coating material being metered onto the surface to be coated from the aforesaid reservoir. In this manner, coating material is consistently and uniformly applied, at the desired coating thickness (determined by the gap between the metering surface and the surface to be coated) without the use of a smoothing means.

The coating apparatus is preferably formed from two members which are constructed and fastened to each other by an adjustable fastening means in a manner such that, at intermediate portions, the members are spaced from each other in adjacent facing planes to define therebetween a coating material reservoir, and at one end, the two members are spaced from each other in adjacent facing planes to define a flow passage for passing coating material from the reservoir to a surface to be coated. The adjustable fastening means permits relative movement between the two members to both adjust the distance between the first and second members and adjust the relative longitudinal positions of the first and second members in the adjacent facing planes to thereby control the flow area of the passage and the distance between a surface to be coated and each of said first and second members. In this manner, one of the members is selectively positioned closer to a surface to be coated to meter coating material onto a surface to be coated, and the other member, which is positioned farther from the surface to be coated, functions to build up coating material, at the outlet of the passage, which is metered onto the surface to be coated.

The coating apparatus of the present invention is particularly suitable for the coating of uniform layers of an imaging suspension onto one of the electrodes of an electrophoretic imaging system.

DESCRIPTION OF THE DRAWINGS

This invention will be further described with respect to preferred embodiments thereof which are illustrated in the accompanying drawings, wherein:

FIG. 1 is an elevational view of an embodiment of the coating apparatus of the present invention;

FIG. 2 is a side cross-sectional view of the coating apparatus of the embodiment illustrated in FIG. 1; and FIG. 3 is a simplified schematic representation of an imaging system utilizing the embodiment of the coating apparatus illustrated in FIG. 1.

DESCRIPTION OF EMBODIMENTS OF THE INVENTION

Referring now to FIG. 1 and 2 of the drawings, there is shown a coating apparatus 10 having a housing 11 comprised of an upper member 12 and a lower member 13 positioned in adjacent facing essentially parallel planes. The upper and lower members 12 and 13 are secured to each other by a first set of fastening means in the form of a transverse row of locking screws 14, and by a second set of fastening means, in the form of a transverse row of screws 15, which are hereinafter described in more detail.

The lower surface of the upper member 12 and the upper surface of the lower member 13 are: in an interfacing relationship at the end portions 14*a* and 15*a*, respectively; spaced from each other at an intermediate portion by facing transverse recessed portions 16 and 17, respectively, defining therebetween a coating material reservoir 18 which extends across the width of housing II; and narrowly spaced from each other at the end portions 19 and 20, respectively, defining a flow passage 21 therebetween which extends across the width of housing 11 for passing material from the reservoir 18 to a surface to be coated. The lower member 13, at the end of passage 21, is provided with a narrow smooth surface 22 which extends across the width of the housing 11, and is essentially perpendicular to the direction of flow in passage 21, the aforesaid surface 22, as hereinafter described, functioning as a metering face for metering coating material onto a surface to be coated. Similarly, the upper member 12, at the end of passage 21, is provided with a narrow smooth surface 23, which extends across the width of housing 11 and is essentially perpendicular to the flow in passage 21, the surface 23 being adapted to provide a reservoir of coating material which, as hereinafter described, is metered onto a surface to be coated.

The lower member 13 is provided with integral upwardly extending side walls 24 and 25 which function as the side walls for the reservoir 18 and passage 21, and the upper member 12 is provided with a fluid inlet connector 24*a* for introducing coating material into reservoir 18. Although the fluid inlet connector 24*a* is particularly shown as being positioned on the top of the upper member 12, it is to be understood that connector 24*a* may be positioned at other portions of the apparatus.

The side walls 24 and 25 are each provided with a smooth bearing surface 31 (only one is shown) which is positioned in a plane parallel to the surface 22 with the surface 22 being set back from the bearing surface 31 by a preselected distance. The bearing surface 31 is adapted to be placed in engagement with the surface to be coated, with the distance between surface 31 and surface 22 fixing the distance between the surface to be coated and the metering surface 22, which in turn fixes the coating thickness. In this manner, the coating apparatus can readily conform to irregularities on the surface to be coated. It is to be understood, however, that the bearing surface 31 could be omitted, in which case, the coating apparatus would be positioned without any portions thereof in engagement with the surface to be coated. Accordingly, the distance between the metering surface and the surface to be coated is not a fixed distance.

The screws 15 extend through oblong bores 31 in upper member 12 and are screwed into the lower member 13, with the oblong bores 31 permitting relative positioning of the upper and lower members 12 and 13 in a longitudinal plane, whereby the surface 22 of lower member 13 can be moved closer to a surface to be coated than the surface 23 of member 12, or vice versa.

The screws 14 extend through bores 32 in upper member 12, and are screwed into the lower member 13 for locking the upper member 12 to the lower member 13. The upper member 12 is constructed with a bending point, generally indicated as 33, which permits relative movement of the upper and lower members 12 and 13, respectively, in a plane perpendicular to the direction of flow in passage 21 to adjust the flow area of passage 21. Accordingly, the screws 14 are tightened in a manner to provide the flow area in passage 21, required to provide the desired flow rate.

In operation, the locking screws 14 are tightened to provide the required flow area in passage 21. The screws 15 are set to adjust the relative positions of the upper and lower members 12 and 13, respectively, to position the surface 22 of lower member 13 closer to the surface to be coated than the surface 23 of upper member 12, whereby a reservoir of coating material is built up between the surface to be coated and the surface 23 of upper member 12, with the coating material being metered from the aforesaid reservoir between the surface to be coated and the surface 22 of lower member 13. The distance between metering surface 22 and the surface to be coated determines the thickness of the coating. The distance between surface 23 of member 12 and the surface to be coated determines the amount of coating material present in the coating material reservoir formed therebetween, with the aforesaid distance being adjusted to provide a reservoir with an amount of material sufficient to insure that material can be consistently and uniformly applied to the surface to be coated at the desired thickness.

The coting apparatus of the present invention may be used for any of wide variety of coating applications; e.g., applying metal coatings on metals, glue to material, etc. The coating apparatus is particularly suitable for applying imaging suspensions to one of the electrodes of an electrophoretic imaging system, and such a system is described with reference to FIG. 3.

The schematic representation of FIG. 3 shows a photoelectrophoretic imaging apparatus having an injecting electrode 111 with a coating of a transparent conductive material 112 such as tin oxide over a transparent glass member 113. Such a combination is commercially available under the name NESA glass from Pittsburgh Plate Glass Company of Pittsburgh, Pa. However, other electrically conductive transparent coatings over transparent substrates are suitable for use herein. The imaging electrode is rotated by a motor (not shown) past processing stations to provide a reproduction of an object 135.

The injecting electrode 111 is initially rotated past the coating apparatus of the present invention to apply an imaging suspension thereon.

The coating apparatus 10 of the present invention is positioned adjacent the injecting electrode 111 to provide a gap between the metering surface 22 thereof and the surface of the injecting electrode 111. The preselected distance between the bearing surfaces 31 which rest on the injecting electrode 111 is determinative of the distance between the metering surface 22 and the injecting electrode 111, which determines the coating thickness of the imaging suspension on electrode 111. The coating apparatus is mounted (not shown), as known in the art, in a manner such that there is sufficient play to permit relative movement between the coating apparatus 10 and the injecting electrode 111 in response to movement of the bearing surfaces 32 in response to irregularities in the injecting electrode 111. As hereinabove noted, the bearing surfaces of the housing 11 of the coating apparatus 10 could be omitted in which case the coating apparatus 10 is mounted in a manner known in the art without being in engagement with the injecting electrode 111. The distance between metering surface 22 and the injecting electrode, as hereinabove disclosed, determines the coating thickness.

The surface 23 of coating apparatus 10 is positioned, as hereinabove described, at a distance from electrode 111 which is greater than the distance between electrode 111 and the surface 22 to provide a reservoir of imaging suspension between surface 23 and electrode 111 from which the imaging suspension is uniformly and consistently coated onto the electrode 111 in the gap between metering surface 22 and electrode 111.

Imaging suspension is introduced into the reservoir 18 of coating apparatus 10 through inlet connector 24a from an imaging suspension supply system (not shown); e.g., such as described in U.S. application Ser. No. 876,646, filed on Nov. 14, 1969, and is then passed from reservoir 18 through passage 21 to the reservoir formed between surface 23 and the electrode 111. The imaging suspension is provided to the coating apparatus at a rate slightly greater than needed to coat the injecting electrode in order to form an imaging suspension reservoir between the coating apparatus 10 and injecting electrode 111.

The injecting electrode 111 having a uniform coating of imaging suspension thereon is rotated to an imaging area, defined by the area between the injecting electrode 111 and the imaging electrode 115. The imaging electrode 115 is comprised of a dielectric material sleeve and a conductive substrate 117 which is preferably a resilient material such as an electrically conductive rubber. The imaging electrode 115 is connected to a potential source 118, while the injecting electrode 111 is shown as electricaly electrically to provide the required field effect at the imaging area between the two electrodes.

A transparency 135 that is to be reproduced is shown passing under a light source 136 and moving synchronously with the injecting electrode 111. From the image formation station or lens 137 by way of the imaging slit 138, the image is projected onto the surface of the imaging suspension at the point of contact between electrodes 111 and 115.

The image projector made up of light source 136, double lens complex 139, transparency 135 and a single lens 138 is provided to expose the suspension on electrode 111 to the light image of the original transparency to be reproduced to provide a particle image on electrode 111, as known in the art.

The image formed on electrode 111 is then rotated to a transfer station at which point the image is transferred to a support sheet 125 which is moved into contact with the electrode 111 by a transfer roller 126 coupled to an electrical source 127 to provide a field with the injecting electrode which is opposite in sign from that at the imaging area. It is to be understood that the image could be also be transferred by an adhesive method, as known in the art.

The injecting electrode is next rotated past a cleaning brush 118 to remove residual particles from the surface of the injecting electrode 111 to prepare the injecting electrode for another imaging cycle.

The details of the imaging system are known in the art; e.g., electrophoretic imaging systems are disclosed in U.S. Pat. Nos. 3,384,565; 3,384,566 and 3,383,993 and, accordingly, no further description of such a system is deemed necessary for a complete understanding of a photoelectrophoretic imaging system which employs the teachings of the present invention.

The use of the coating apparatus of the present invention in a photoelectrophoretic imaging system has been particularly described with respect to applying ink to the injecting electrode, but it is to be understood that the coating apparatus may also be employed in a system in which the ink is applied to the blocking electrode; e.g., as described in U.S. Pat. No. 3,427,242.

The coating apparatus of the present invention is particularly advantageous in that uniform coatings may be applied to a surface without the use of a smoothing means. The coating apparatus is particularly suitable for photoelectrophoretic imaging systems in that ink may be effectively uniformly applied to one of the electrodes without the necessity for a smoothing means, thereby improving the overall system.

Numerous modificiations and variations of the present invention are possible in light of the above teachings and, therefore, within the scope of the appended claims the invention may be practiced other than as particularly described.

What is claimed is:

1. A coating method with apparatus comprising upper and lower members which define top and bottom walls, respectively, of a coating material reservoir and a passage for passing coating material from the reservoir to a surface to be coated, each of said members at the end of said passage including a passage surface closely adjacent the surface to be coated, one of said passage surfaces being closer to the surface to be coated than the other; means for introducing a coating material into the reservoir and through the end of said passage; two sidewalls, the inside surfaces of which contact said passage surfaces to define the end of said passage; each sidewall provided with a smooth bearing surface positioned in a plane parallel to the closer of said passage surfaces to the surface to be coated, said closer passage surface being set back from said bearing surfaces by a preselected distance which determines the desired coating thickness, the bearing surfaces adapted to be placed in contact with portions of the surface to be coated which are not to be coated comprising the steps of:

a. advancing a surface to be coated in a direction from the passage surface further from the surface to be coated toward the passage surface closest to the surface to be coated without contacting the surface to be coated with either of said first and second passage surfaces, while continuously contacting said smooth bearing surfaces to portions of the surface to be coated which are not to be coated;

b. building a bead of coating material in the space defined by the surface to be coated, the inside of said member ending in the passage surface closer to the surface to be coated and said passage surface further from the surface to be coated; and c. coating the coating material onto the surface to be coated between the closer of said passage surfaces from the bead of coating material built in the space defined by the surface to be coated, the inside of said member ending in the passage surface closer to the surface to be coated and said passage surface further from the surface to be coated, the passage surface closest to the surface to be coated functioning as a metering face for metering coating material onto the surface to be coated.

2. A method according to claim 1 wherein said passage surfaces are planar and positioned in essentially parallel planes which are essentially perpendicular to the flow of coating material through said passage, wherein said upper and lower members are moveable with respect to each other, and further including two sets of screws, one set of screws for adjusting the distance between the upper and lower members at the end of the passage to control the flow area of the end of the passage, both sets of screws for adjustably securing the relative longitudinal positions of said upper and lower members.

* * * * *